US005815061A

United States Patent [19]

Ho

[11] Patent Number: 5,815,061

[45] Date of Patent: Sep. 29, 1998

[54] LOW COST AND MANUFACTURABLE TRANSFORMER MEETING SAFETY REQUIREMENTS

[75] Inventor: Francis Man Shuen Ho, Sheung Shui, Hong Kong

[73] Assignee: Computer Products, Inc., Boca Raton, Fla.

[21] Appl. No.: 588,950

[22] Filed: Jan. 19, 1996

[51] Int. Cl.[6] ..... H01F 27/29; H01F 27/30

[52] U.S. Cl. ..... 336/192; 336/198; 336/206

[58] Field of Search ..... 339/198, 208, 339/192, 206

[56] References Cited

U.S. PATENT DOCUMENTS

| | | | |
|---|---|---|---|
| 3,117,294 | 1/1964 | Muszynski et al. | 336/192 |
| 3,605,055 | 9/1971 | Grady | 336/185 |
| 3,909,761 | 9/1975 | Miles | 336/192 |
| 4,000,483 | 12/1976 | Cook et al. | 336/98 |
| 4,549,130 | 10/1985 | Dobberstein | 323/308 |
| 4,652,810 | 3/1987 | Hayashi | 323/357 |
| 4,800,357 | 1/1989 | Nickels, Jr. et al. | 336/198 |
| 4,804,340 | 2/1989 | Hamer et al. | 439/709 |
| 4,904,974 | 2/1990 | Tsuji | 336/192 |
| 4,980,664 | 12/1990 | Harwood | 336/192 |
| 4,999,743 | 3/1991 | Fontana et al. | 361/400 |
| 5,010,314 | 4/1991 | Estrov | 336/198 |
| 5,036,580 | 8/1991 | Fox et al. | 29/605 |
| 5,157,368 | 10/1992 | Okano et al. | 336/90 |
| 5,175,525 | 12/1992 | Smith | 336/83 |
| 5,317,300 | 5/1994 | Boesel | 336/96 |

FOREIGN PATENT DOCUMENTS

| | | | |
|---|---|---|---|
| 2422236 | 11/1979 | France | 336/208 |
| 52-76634 | 6/1977 | Japan | 336/198 |
| 6-132144 | 5/1994 | Japan | 336/198 |
| 479149 | 11/1969 | Switzerland | 336/208 |

OTHER PUBLICATIONS

Underwriters Laboratories, Inc. Standard UL 1950 for Safety of Information Technology Equipment, Including Electrical Business Equipment, Feb. 26, 1993, pp. 1–10, 19–30, 49–76, (second edition).

*Primary Examiner*—Thomas J. Kozma
*Attorney, Agent, or Firm*—Skjerven, Morrill, MacPherson, Franklin & Friel LLP; T. Lester Wallace; Michael J. Halbert

[57] ABSTRACT

A transformer bobbin has margining ledges disposed on either side of a primary winding surface such that a primary wire is wound between margining surfaces of the margining ledges. L-shaped grooves extend into the margining ledges and then parallel to the primary winding surface to accommodate the primary wire ends that connect to terminals of the bobbin. Margining of the secondary is accomplished with a pair of margining bibs which attach to the bobbin after the primary is wound and after a layer of insulation is placed over the primary. The secondary is wound over the insulation layer between margining surfaces of the bibs. With the margining ledges and bibs, required creepage distances can be maintained without the use of sleeving, margining tape, interlayer tape or holding tape.

3 Claims, 4 Drawing Sheets

LOW COST AND MANUFACTURABLE TRANSFORMER MEETING SAFETY REQUIREMENTS

FIELD OF THE INVENTION

The present invention relates to transformers.

BACKGROUND INFORMATION

FIG. 1 (Prior Art) is a view of a transformer bobbin 1 (sometimes called a "coil form"). The transformer bobbin 1 includes an annular primary winding member having an outer primary winding surface 2, a first face plate 3 and a second face plate 4.

FIG. 2 (Prior Art) is a cross-sectional view of part of the bobbin 1 of FIG. 1 taken along plane A (shown as a dashed plane) after a primary winding and a secondary winding have been wound on the bobbin to form a transformer. To make the transformer, a length of insulated wire is wrapped on the primary winding surface 2 around axis B to form a primary winding 5. One end of the wire of the primary is attached to terminal 6 and the other end is attached to terminal 7. Another length of insulated wire is then wrapped around the primary winding 5 to form a secondary winding 8. One end of the wire of the secondary is attached to terminal 9 and the other end is attached to terminal 10.

For safety considerations, precautions are taken to ensure that the primary and secondary do not become shorted together. In the UL 1950 standard from Underwriters Laboratories, Inc. (the subject matter of which is incorporated herein by reference), for example, there are requirements for numerous transformer characteristics and materials including the insulation between the primary and secondary, an isolation characteristic called "creepage", and another isolation characteristic called "clearance". Creepage, generally speaking, is the minimum distance along a surface of insulation between the primary and the secondary. Clearance, generally speaking, is the minimum distance between the primary and secondary through open space (i.e., air).

Three layers of insulation 11 are therefore provided between primary and secondary. If insulation 11 were to terminate in the axial dimension at extent C and extent D, however, there would not be an adequately large creepage. The distance on a surface from primary winding cross-section 12 to secondary winding cross-section 13 would be too short around the left end of the insulation 11. To increase the creepage between primary winding cross-section 12 and secondary winding cross-section 13, insulation 11 is made to extend in the axial dimension outside the extents C and D of the primary and secondary. To form this structure with the primary and secondary confined between C and D, strips of margining tape 14 are placed at the axial extents of the primary winding surface 2 as shown before the wire of the primary is wound. The wire of the primary is then wound inside the margining tape 14. After the primary is wound, the layer of insulation 11 is placed over the primary such that the insulation extends from axial extent E to axial extent F over the margining tape 14. Next, other strips of margining tape 15 are applied over the insulation 11 and the secondary 8 is wound between extents C and D.

The ends of the wires of the primary and secondary, however, must extend to the terminals of the transformer. If, as is shown in FIG. 2, one end of the wire of the primary 5 extends to the left over the three layers of primary windings, over a part of the margining tape 14, and to the terminal 6, then the creepage distance would be short where this lead extends through extent E. (The windings of the primary are shown in cross-section in FIG. 2 and a portion of the primary wire is shown extending horizontally from the rightmost extent of the primary, behind the cross-sectional windings, over margining tape 14 and to terminal 6. Because the cross-section of FIG. 2 is the bottom half of the transformer, the primary wire "over" the margining tape 14 is illustrated underneath margining tape 14. Similarly, although the secondary wire is shown underneath the primary wire, the secondary is actually wound "over" the primary.) The creepage distance, rather than extending to the left from extent C on the primary, to the left on the bottom surface of insulation 11, up around the left end of insulation 11, to the right on the top surface of insulation 11, and to extent C and the secondary, the creepage distance would extend from the wire of the primary at extent E, to the right on the top surface of insulation 11, and to secondary cross-section 13 at extent C.

To solve this creepage problem, an insulating sheath 16 is placed over the wire of the primary from terminal 6 through to extent C of the primary. With the sheath, the creepage distance is increased due to the additional intervening surface (the outside surface of the sheath) between the primary and secondary. The other wire ends are provided with similar sheaths to increase creepage in the same way.

Because the margining tape is of a soft material, windings may be squeezed into the soft tape margin region by the force of overlying windings. Accordingly, interlayer tape 17 is provided which runs over the full axial extent of each layer of the primary. Additionally, holding tape 18 is provided on the leftmost and rightmost ends of each layer to secure winding positioning.

Placing the margining tape, the interlayer tape, the holding tape, and the sheaths is done by hand. Accordingly, making the transformer of FIG. 2 is generally time consuming, labor intensive and expensive. A transformer is therefore sought which meets the safety requirements but which can be manufactured with a greater degree of mechanization.

SUMMARY

A transformer bobbin has margining ledges disposed on either side of a primary winding surface such that a primary wire is wound onto the primary winding surface between margining surfaces of the margining ledges. L-shaped grooves extend into the margining ledges and then parallel to the primary winding surface to accommodate the primary wire ends that connect to terminals of the bobbin. Margining of the secondary is accomplished with a pair of margining bibs which attach to the bobbin after the primary is wound and after a layer of insulation is placed over the primary. The secondary is wound over the insulation layer between margining surfaces of the bibs. With the margining ledges and bibs, required creepage distances can be maintained without the use of sleeving, margining tape, interlayer tape or holding tape.

This summary does not purport to define the invention. The invention is defined by the appended claims.

DETAILED DESCRIPTION OF THE PREFERRED EMBODIMENTS

Figure 3:
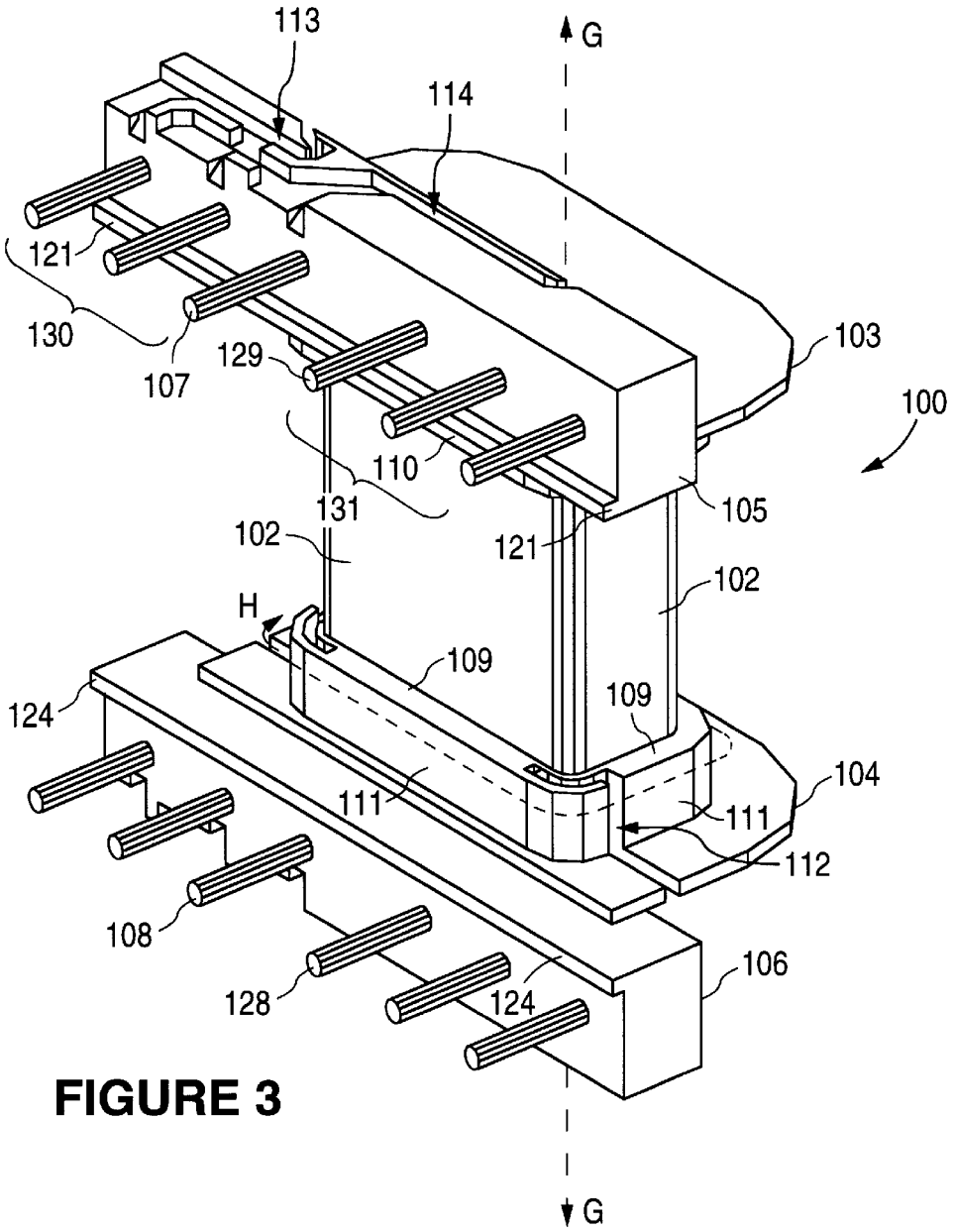
FIG. 3 is a perspective view of a transformer bobbin in accordance with the present invention.

FIG. 3 is a perspective view of a bobbin 100 in accordance with the present invention. An injection molded plastic bobbin 100 includes an annular primary winding member 101 having a primary winding surface 102, a first face plate 103, a second face plate 104, a first base member 105, a second base member 106. Metal terminals, including terminals 107 and 108, extend into the base members. The primary winding surface 102 is disposed around axis G such that insulated transformer wire can be wrapped onto primary winding surface 102 by wrapping it around axis G. A margining ledge 109 integrally formed with the primary winding member 101 is provided adjacent second face plate 104. Similarly, a margining ledge 110 integrally formed with the primary winding member 101 is provided adjacent first face plate 103.

Margining ledge 109 has an elongated outer surface 111 which extends lengthwise in direction H around primary winding surface 102 such that outer surface 111 is parallel with primary winding surface 102 as surfaces 111 and 102 extend around axis G. A groove 112 extends into the margining ledge from the outer surface 111 and then extends in a direction substantially parallel to the primary winding surface 102 and substantially parallel to the outer surface 111.

Figure 3A:
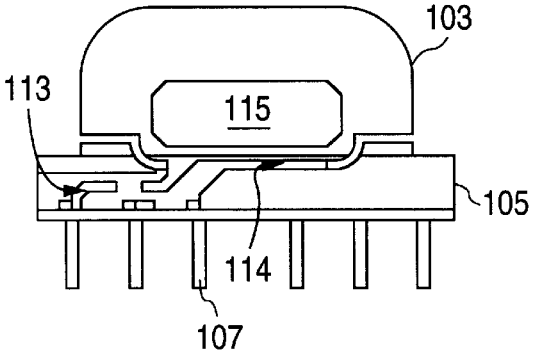
FIG. 3A is an end view of the bobbin of FIG. 3.
Figure 3B:
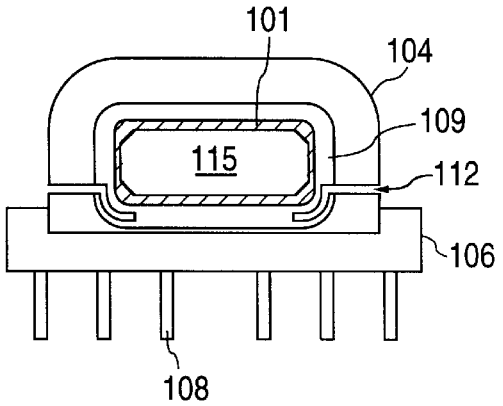
FIG. 3B is a cross-sectional view of the bobbin of FIG. 3.

FIG. 3A is an end view of the bobbin 100 looking toward side face 103. FIG. 3B is a cross-sectional view taken in a plane perpendicular to axis G. In the view of FIG. 3B, groove 112 has an L-shape. A first leg of the L-shaped groove is a straight leg which extends through the second face plate 104 and into the margining ledge 109. A second leg has a curved shape which extends in direction H and follows the contour of the primary winding surface 102. Margining ledge 110 adjacent the first face plate 103 has L-shaped grooves (not shown) similar to those in margining ledge 109.

The outer side of the base members 105 have wire-accommodating slots 113 and 114. Each slot leads from a respective groove in margining ledge 110 (not shown) to a respective terminal. FIG. 3A shows slots 113 and 114 from the side. The hole through the center of the bobbin about which the primary and secondary are wound is labeled 115. In the final transformer, a pair of E-shaped ferrite cores (now shown) is placed on the bobbin such that the center prongs of the two Es meet in the center of hole 115. Ferrite of the center prongs therefore extends through the hole 115.

Figure 4:
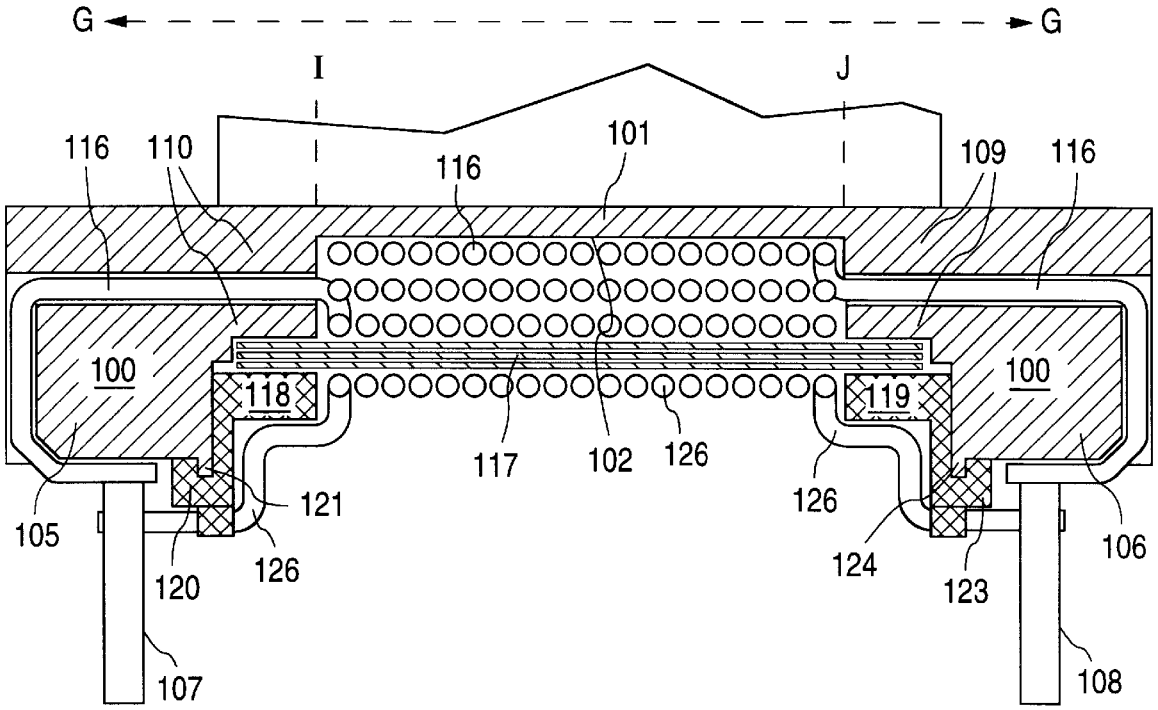
FIG. 4 is a cross-sectional view of a part of a transformer in accordance with the present invention having a bobbin, a primary, an insulation layer, a secondary, and a pair of margining bibs.

FIG. 4 is a cross-sectional view showing a portion of bobbin 100. FIG. 4 is not taken in a plane, but rather in several planes. Note that terminals 107 and 108 are shown in cross-section as well as groove 112.

To make a transformer, a length of 116 insulated transformer wire is guided through L-shaped groove 112 (see FIG. 3) such that one end of the wire 116 extends through the plane of second side face 104. This end is placed in a wire-accommodating slot (not shown) in the outside surface of second base member 106 which leads to terminal 108 in the second base member 106. This wire-accommodating slot (not shown) has the same appearance as slot 114 in first base member 105.

The other end of the wire 116 is wrapped onto the primary winding surface 102 around axis G between the margining plane J of margining ledge 109 and margining plane I of margining ledge 110. Due to the rigid margining surfaces provided by the margining ledges 109 and 110, problems associated with soft margining tape are avoided. Interlayer tape and holding tape are not required. In FIG. 4, three layers of primary winding wire 116 are provided. The second end of the wire 116 is then extended through a L-shaped groove in margining ledge 110, through the plane of first side face 103, through wire-accommodating slot 114, and to terminal 107.

Although the wire 116 is described here as extending through the slots in the base members in this point in the assembly of the transformer, it is to be understood that the ends of the wire can be placed in the slots and then attached to the appropriate terminals at a later time in the assembly process. The complete path of the wire 116 of the primary is described at this point in the assembly process for illustrative purposes.

With the primary wire 116 in place, a layer of insulation 117 (such as three layers of 5 mil mylar film) is wrapped around the primary winding. The insulation layer is made to extend past the axial extent of the primary (to the left beyond plane I a certain distance and to the right beyond plane J a certain distance). This distance is determined by the creepage distance required between the primary and the secondary.

Figure 5A:
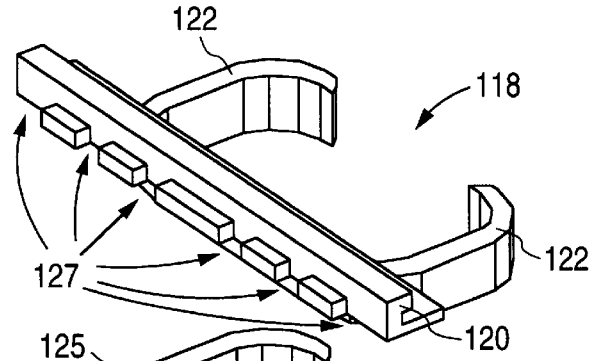
FIGS. 5A and 5B are perspective views of a pair of margining bibs in accordance with the present invention.
Figure 5B:
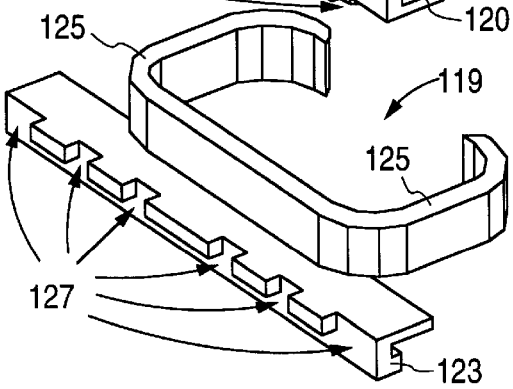

FIGS. 5A and 5B are perspective views of a pair of injection molded plastic bibs 118 and 119 which snap onto the bobbin/wire/insulation assembly. First bib 118, for example, has a lip 120 which fits over a tongue 121 on the first base member 105. First bib 118 also has a open C-shaped portion 122 which snaps onto the insulation which overlays the margining ledge 110 so that a margining plane for a secondary is formed by the first bib 118 which is in the same plane as the margining plane I of the primary. Second bib 119 is formed in similar fashion so that a lip 123 fits over a tongue 124 of the second base member 106 and so that a C-shaped portion 125 forms a margining plane for the secondary which is in the same plane as the margining plane J of the primary. FIG. 4 shows the bibs 118 and 119 in place.

With the bibs 118 and 119 in place, a length of insulated transformer wire 126 is wrapped over the insulation layer 117 around axis G between margining planes I and J. As shown in FIG. 4, the ends of the wire 126 of the secondary extend over the bids 118 and 119, through slots 127 in the bibs, and to the appropriate terminals (such as terminals 128 and 129).

Two E-shaped ferrite cores (not shown) are then placed onto the bobbin assembly such that the center prongs of the two Es meet in the center hole 115 of the bobbin. Securing tape is then wrapped around the ferrite cores to hold them in place on the bobbin and the entire assembly is dipped into a lacquer material in conventional fashion.

Figure 1:
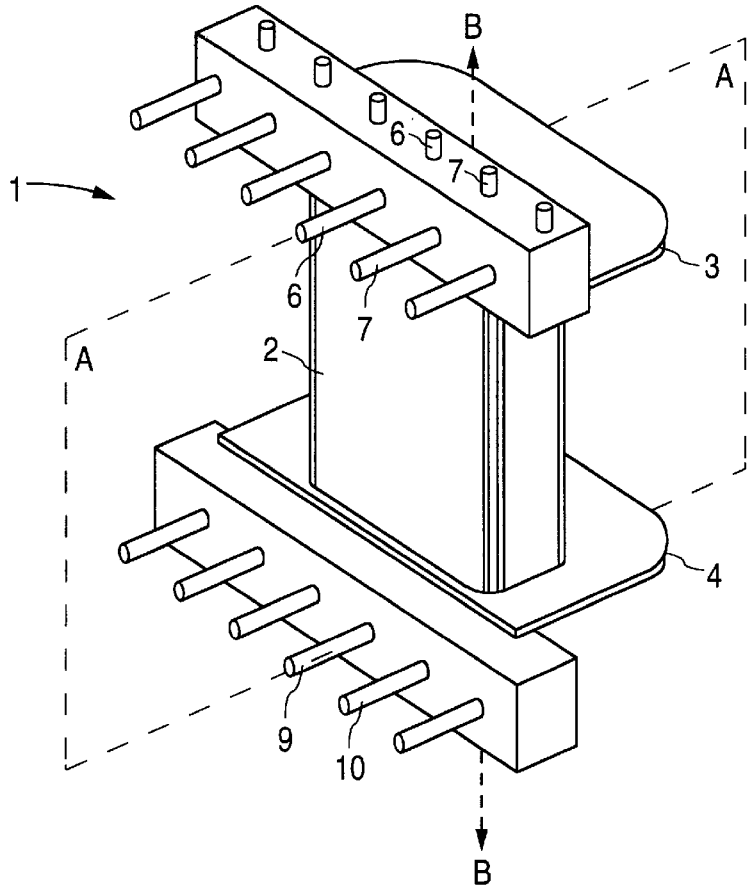
FIGURE 1 (PRIOR ART)
FIGS. 1 and 2 (Prior Art) are views of a conventional transformer bobbin.
Figure 2:
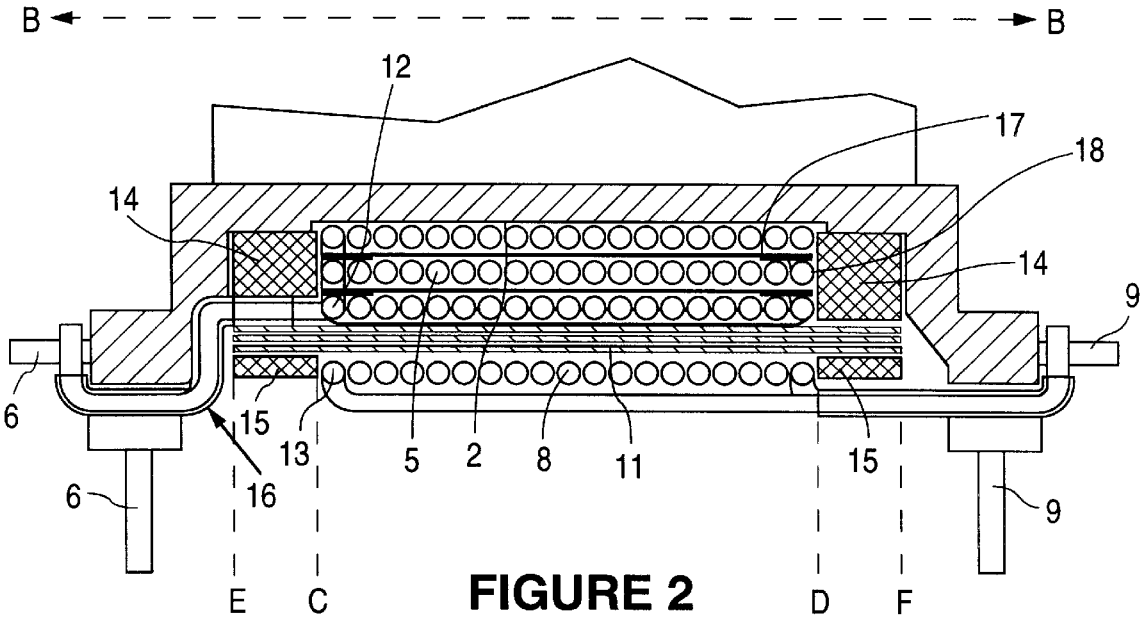
FIGURE 2 (PRIOR ART)

The creepage distance requirement is met without the use of margining tape or sleeving. Because the primary wire 116 does not extend along a surface of the insulation layer 117 to the left of plane I, the creepage distance from the lower left cross-sectional primary winding of FIG. 4 to the leftmost secondary winding of FIG. 4 extends to the left past plane I along the bottom surface (shown as the top in FIG. 4) of insulation layer 117, around the end of insulation layer 117, and then back to the right on the top surface (shown as the bottom in FIG. 4) of insulation layer 117 to the secondary winding. No sleeving is required. In the case of FIG. 2 (Prior Art), on the other hand, if sleeving 16 were not provided, a short creepage distance would exist from the primary wire 15 to the right along what is illustrated as the bottom surface of insulation layer 11 to secondary winding 13.

Additionally, as shown in FIG. 3, the terminals on the base members are not evenly spaced. The leftmost three terminals 130 are separated by a greater distance from the rightmost three terminals 131 to increase creepage between terminal 107 and terminal 129. In this way, both the primary and the secondary can be connected to terminals on the same base member. Terminals 130 can be used for primaries, for example, and terminals 131 can be used for secondaries. This may obviate the need to extend a wire in the axial dimension over windings just to connect the appropriate terminal such as in FIG. 2 where the wire of the primary 5 extends over the third layer (an odd numbered layer) of the primary from the right side of the primary to the left side of the primary just to connect to terminal 6 at the left of the structure.

Figure 6A:
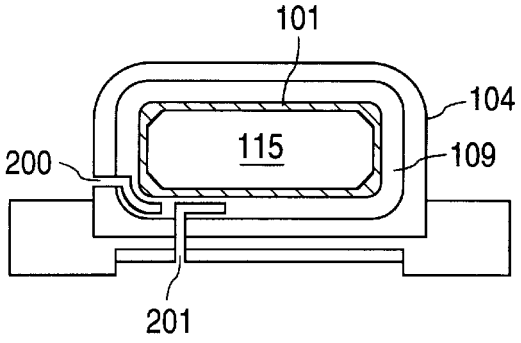
FIGS. 6A and 6B are cross-sectional diagrams showing other possible Margining ledge groove configurations in accordance with the present invention.
Figure 6B:
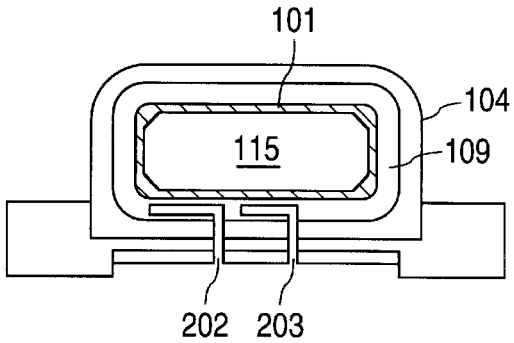
Figure 7A:
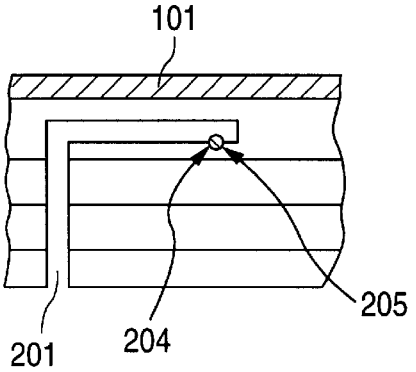
FIGS. 7A–7C illustrate various embodiments for securing a wire in a margining ledge groove in accordance with the present invention.
Figure 7B:
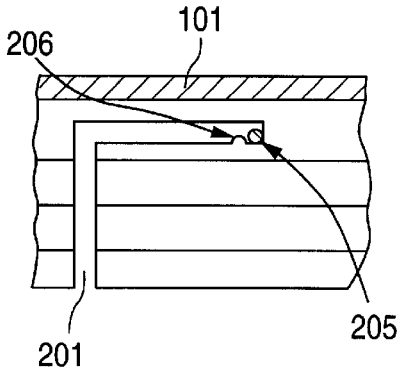
Figure 7C:
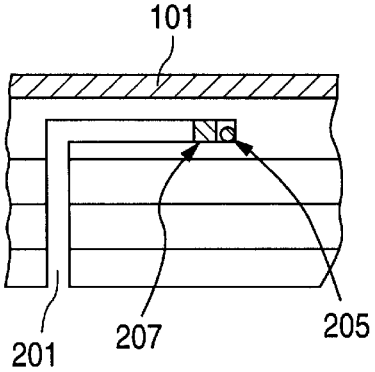

FIGS. 6A and 6B are cross-sectional diagrams showing other possible groove (200–203) configurations in accordance with the present invention. FIGS. 7A–7C illustrate various embodiments for securing a wire 205 in an L-shaped groove 201 in a bobbin. In the embodiment of FIG. 7A, an indentation 204 is provided in the groove 201 which accommodates the wire 205. In the embodiment of FIG. 7B, a ridge 206 is provided in the groove 201 over which the wire 205 snaps into place. In the embodiment of FIG. 7C, a block 207 of foam or other suitable material is placed into the groove 201 to hold the wire 205 in place.

Although certain exemplary specific embodiments have been described in order to illustrate the invention, the invention is not limited to the specific embodiments. Accordingly, various modifications, adaptations and combinations of selected features of the specific embodiments are within the scope of the present invention as set forth in the appended claims.

What is claimed is:

1. A transformer comprising:

a bobbin having a primary winding surface and a margining ledge integrally formed with the primary winding surface, the margining ledge having an elongated outer surface which extends lengthwise in a direction substantially parallel to said primary winding surface, a groove extending through a portion of the margining ledge from the outer surface of the margining ledge inward toward the primary winding surface and then extending through another portion of the margining ledge in a direction substantially parallel to the primary winding surface and substantially parallel to the outer surface of the margining ledge, wherein the primary winding surface is disposed about an axis such that the axis does not pass through the primary winding surface, the bobbin having a first face plate and a second face plate, the first face plate having a surface which extends in a first plane perpendicular to the axis, the second face plate having a surface which extends in a second plane perpendicular to the axis, the primary winding surface being disposed between the first and second planes, the transformer further comprising:

a primary winding wire extending through the first plane and through the margining ledge in the groove in a direction substantially parallel to the axis, and extending around the axis numerous times over the primary winding surface but not extending over the outer surface of the margining ledge, a portion of the margining ledge being disposed between the wire where the wire passes through the margining ledge and the portion of the outer surface of the margining ledge which is closest to the portion of the wire;

a layer of insulation extending from the first face plate over the margining ledge and to the second face plate such that the primary winding wire which extends around the axis is disposed between the layer of insulation and the primary winding surface;

a collar shaped margining bib which fits over the margining ledge such that a portion of the layer of insulation is sandwiched between the bib and the outer surface of the margining ledge; and a secondary winding wire extending around the axis over the layer of insulation, the bib margining the second winding wire which extends around the axis to the same extent in the axial dimension as the margining ledge margins the first winding wire which extends around the axis.

2. The transformer of claim 1, wherein the collar-shaped margining bib has an open-ended C-like shape when viewed in a cross-section taken perpendicular to the axis, the margining bib clipping onto and gripping the insulation on the margining ledge.

3. The transformer of claim 1, wherein a portion of the secondary winding wire which does not extend around the axis extends in a direction substantially parallel to the axis and over the collar-shaped margining bib.

* * * * *